United States Patent [19]

Finch et al.

[11] Patent Number: 4,626,374

[45] Date of Patent: Dec. 2, 1986

[54] HEAVY METAL ADJUNCTS, THEIR PREPARATION AND USE

[75] Inventors: Timothy D. Finch, Bromborough; Raymond J. Wilde, Higher Bebington, both of United Kingdom

[73] Assignee: Lever Brothers Company, New York, N.Y.

[21] Appl. No.: 668,451

[22] Filed: Nov. 5, 1984

[30] Foreign Application Priority Data

Nov. 8, 1983 [GB] United Kingdom ..... 8329761

[51] Int. Cl.[4] ..... C11D 17/00; C11D 17/04; C11D 17/06

[52] U.S. Cl. ..... 252/174.13; 252/94; 252/186.2; 252/186.25

[58] Field of Search ..... 852/94, 95, 135, 174, 852/174.13, 186.2, 186.25

[56] References Cited

U.S. PATENT DOCUMENTS

| | | | |
|---|---|---|---|
| 3,156,654 | 11/1964 | Konecny et al. | 252/95 |
| 3,398,076 | 8/1968 | Das et al. | 252/95 |
| 3,532,634 | 10/1970 | Woods | 252/95 |
| 4,208,295 | 6/1980 | Sai et al. | 252/94 |
| 4,444,674 | 4/1984 | Gray | 252/95 |

FOREIGN PATENT DOCUMENTS

| | | |
|---|---|---|
| 6655 | 1/1981 | European Pat. Off. . |
| 25608 | 3/1981 | European Pat. Off. . |
| 72166 | 2/1983 | European Pat. Off. . |
| 82563 | 6/1983 | European Pat. Off. . |

*Primary Examiner*—Paul Lieberman
*Assistant Examiner*—Hoa Van Le
*Attorney, Agent, or Firm*—Milton L. Honig; James J. Farrell

[57] ABSTRACT

A stable heavy metal adjunct, particularly manganese adjunct, for use as a peroxygen bleach catalyst is disclosed which comprises a matrix of a heavy meal salt provided with a surface powder coating of desiccant microsized powdered material having a mean particle size of less than 25 μm.

A process for preparing said adjunct and bleaching and detergent compositions containing said adjunct are also disclosed.

Preferred heavy metal is manganese and preferred surface powder coating is with microsized silicon dioxide (silica).

16 Claims, 2 Drawing Figures

HEAVY METAL ADJUNCTS, THEIR PREPARATION AND USE

Figure 1:
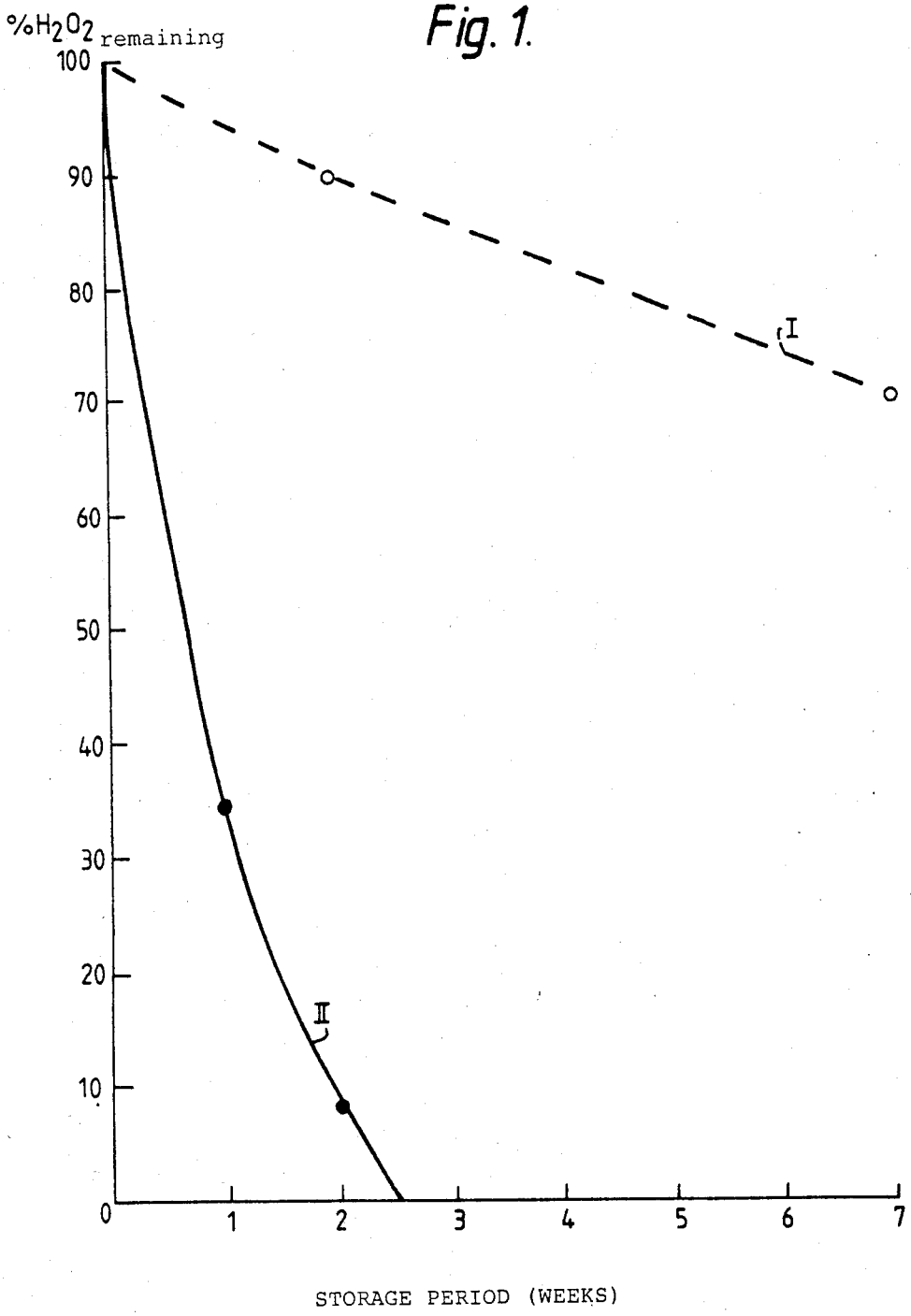

This invention relates to stable heavy metal adjuncts for use as a bleach catalyst, to a process for the preparation of such adjuncts, and to solid particulate bleaching and detergent compositions comprising said adjuncts.

It is known that heavy metals having atomic numbers of from 24 to 29 in the Periodic Table not only catalyse peroxide decomposition but can also act under certain circumstances to enhance the oxidizing activity of peroxide bleaching agents.

In European Patent Application No. 0 072 166 there is described a catalyst system for peroxygen bleaching agents comprising a heavy metal cation, an auxiliary metal cation and a sequestering agent.

In European Patent Application No. 0 082 563 there are described the outstanding properties of manganese as a bleach catalyst and its advantageous use in low to medium temperature fabric washing compositions.

Catalytic heavy metal cations, when incorporated in bleaching and detergent compositions comprising a peroxygen bleaching agent, tend to cause bleach loss during storage due to possible catalyst/bleach interaction.

It has been proposed to precomplex the catalytic heavy metal cation with at least an equimolar amount of sequestrant and dry-mixing it with the remainder of the composition for improving composition storage stability.

In the case of manganese it has been found that manganese incorporation as a manganous salt or complex can also lead to bleach decomposition on storage *and* the formation of $MnO_2$ caused by the interaction of Mn with the peroxygen bleach. There is consequently a risk of brown staining of fabrics resulting from $MnO_2$ deposition.

These problems cannot be overcome by said precomplexing method as proposed in the art.

The present invention is primarily directed to solving the manganese problems, but is also applicable to other heavy metal cations.

It has now been found that the above problems can be overcome by using an adjunct comprising a manganese salt provided with a surface powder coating of microsized powdered material with a mean particle size of less than 25 μm, preferably less than 10 μm.

There is no critical lower limit of the usable powdered material particle size, since the finer the material the better the effect will be. However, for practical reasons, e.g. ease of handling, particle sizes of less than 0.1 μm should preferably be avoided.

Although the present invention as stated above is particularly concerned with manganese cations and will be further illustrated mainly with respect to manganese, it should be appreciated that it is not limited thereto, since said surface powder coating can also be applied to other heavy metal salts for effectively improving the composition storage stability.

Not all microsized powdered materials are suitable for preparing the manganese or other heavy metal adjuncts, since purely physical separation, e.g. by surface powder coating with microsized calcite of particle sizes in the same order (e.g. 3–4 μm), has been found to give ineffective protection.

Without wishing to be bound to any theory, we believe that the physical properties of the microsized powdered material are important, in this case slow moisture transport into the matrix, which means that the microsized powdered material should act as a desiccant.

A preferred microsized powdered material is microsized silicon dioxide (silica).

The heavy metal salt suitable in the present invention may be any heavy metal salt which produces the catalytic heavy metal cations in solution. Catalytic heavy metals include those heavy metals having atomic numbers of 24 to 29 in the Periodic Table, i.e. Cr, Mn, Fe, Co, Ni and Cu. A preferred heavy metal salt is a manganese (II) salt, such as for example manganous sulphate and manganous chloride.

The surface powder coating can be applied to the heavy metal salt by simple dusting thereof with a suitable microsized powdered material in any suitable equipment, an art that is known per se to the skilled artisan.

Generally the microsized powdered material for surface powder coating is used in an amount of about 0.5 to 20% by weight of the heavy metal (e.g. manganese) salt in order to obtain a stable heavy metal (e.g. manganese) adjunct. Though higher amounts, e.g. up to about 40% by weight, may also be used, it was found that in most cases such excessive levels of surface powder coating were unnecessary.

The heavy metal adjunct of the invention can be employed in a peroxygen bleach containing detergent composition comprising a sequestrant builder without causing undue decomposition of the peroxygen bleach.

A manganese adjunct of the invention when incorporated in a peroxygen-bleach-containing detergent composition comprising a sequestrant builder avoids not only undue decomposition of the peroxygen bleach during storage but also the formation of manganese dioxide upon powder dissolution which may cause brown staining of fabrics in the wash.

Preferred adjuncts will comprise a heavy metal salt provided with a surface powder coating of microsized powdered material in an amount of from about 1–10% by weight of the heavy metal salt.

Accordingly, in one aspect of the invention a stable heavy metal adjunct for use as a bleach catalyst comprises a matrix of a heavy metal salt provided with a surface powder coating of desiccant microsized powdered material with a mean particle size of less than 25 μm, in an amount of from about 0.5 to 20% by weight of the heavy metal salt.

In another aspect of the invention a stable heavy metal adjunct for use as a bleach catalyst is prepared by dusting a heavy metal salt with a desiccant microsized powdered material with a mean particle size of less than 25 μm.

In still another aspect of the invention a solid particulate bleaching and detergent composition comprises a peroxygen bleaching agent, a sequestrant builder and a heavy metal adjunct, characterised in that said heavy metal adjunct comprises a matrix of a heavy metal salt provided with a surface powder coating of desiccant microsized powdered material with a mean particle size of less than 25 μm.

The heavy metal adjunct according to the invention is preferably a manganese adjunct which is prepared by dusting a manganese (II) salt with said microsized powdered material.

A preferred microsized powdered material is microsized silicon dioxide having a mean particle size of preferably less than 10 μm.

Preferred manganese adjuncts will comprise a micro-sized silicon dioxide surface powder coating in an amount of from about 1 to 10% by weight of the manganese salt.

The solid particulate bleaching and detergent composition comprising the preferred manganese adjunct of the invention contains a peroxygen bleaching agent and a sequestrant builder as essential components.

The peroxygen bleaching agent used herein includes hydrogen peroxide adducts, e.g. inorganic persalts, which liberate hydrogen peroxide in aqueous solutions, such as the alkali metal perborates, percarbonates, perphosphate, persilicates and the like.

The sequestrant builder may be inorganic or organic in nature. Preferred sequestrant builders are strong complexing agents, such as the alkali metal polyphosphates, triphosphates, borates and the water-soluble polycarboxylates such as the salts of nitrilotriacetic acid, ethylene diamine tetraacetic acid and citric acid. A preferred sequestrant builder is sodium triphosphate.

In practice the solid particulate bleaching and detergent composition may comprise from about 5 to 90%, preferably 5–35% by weight of the peroxygen bleaching agent, from about 5 to 95%, preferably 10–60% by weight of the sequestrant builder, and from 0.025 to 10%, preferably from 0.05 to 5% by weight of the heavy metal adjunct.

The composition usually also contains a surface-active agent, generally in an amount of from about 2% to 50% by weight, preferably from 5 to 30% by weight. The surface-active agent can be anionic, nonionic, zwitterionic or cationic in nature or mixtures of such agents.

Preferred anionic non-soap surfactants are water-soluble salts of alkylbenzenesulphonate, alkyl sulphate, alkylpolyethoxyether sulphate, paraffin sulphonate, alphaolefin sulphonate, alpha-sulphocarboxylates and their esters, alkylglycerylethersulphonate, fatty acid monoglyceride-sulphates and-sulphonates, alkylphenol-polyethoxy ethersulphate, 2-acyloxy-alkane-1-sulphonate, and beta-alkyloxy alkanesulphonate. Soaps are also preferred anionic surfactants.

Especially preferred are alkylbenzenesulphonates with about 9 to about 15 carbon atoms in a linear or branched alkyl chain, more especially about 11 to about 13 carbon atoms; alkylsulphates with about 8 to about 22 carbon atoms in the alkyl chain, more especially from about 12 to about 18 carbon atoms; alkylpolyethoxy ethersulphates with about 10 to about 18 carbon atoms in the alkyl chain and an average of about 1 to about 12 —$CH_2CH_2O$—groups per molecule, especially about 10 to about 16 carbon atoms in the alkyl chain and an average of about 1 to about 6 —$CH_2CH_2O$—groups per molecule; linear paraffin sulphonates with about 8 to about 24 carbon atoms, more especially from about 14 to about 18 carbon atoms and alpha-olefin sulphonates with about 10 to about 24 carbons atoms, more especially about 14 to about 16 carbon atoms; and soaps having from 8 to 24, especially 12 to 18 carbon atoms.

Water-solubility can be achieved by using alkali metal, ammonium, or alkanolamine cations; sodium is preferred. Magnesium and calcium may be preferred cations under certain circumstances.

Preferred nonionic surfactants are water-soluble compounds produced by the condensation of ethylene oxide with a hydrophobic compound such as an alcohol, alkyl phenol, polypropoxy glycol, or polypropoxy ethylene diamine.

Especially preferred polyethoxy alcohols are the condensation product of 1 to 30 moles of ethylene oxide with 1 mol of branched or straight chain, primary or secondary aliphatic alcohol having from about 8 to about 22 carbon atoms; more especially 1 to 6 moles of ethylene oxide condensed with 1 mol of straight or branched chain, primary or secondary aliphatic alcohol having from about 10 to about 16 carbon atoms; certain species of poly-ethoxy alcohol commercially available under the trade-names of "Neodol"®, "Synperonic"® and "Tergitol"®.

Preferred zwitterionic surfactants are water-soluble derivatives of aliphatic quaternary ammonium, phosphonium and sulphonium cationic compounds in which the aliphatic moieties can be straight or branched, and wherein one of the aliphatic substituents contains from about 8 to 18 carbon atoms and one contains an anionic water-solubilizing group, especially alkyldimethylpropanesulphonates and alkyldimethyl-ammoniohydroxypropane-sulphonates wherein the alkyl group in both types contains from about 1 to 18 carbon atoms.

Preferred cationic surface active agents include the quaternary ammonium compounds, e.g. cetyltrimethylammonium-bromide or -chloride and distearyldimethylammonium-bromide or -chloride, and the fatty alkyl amines.

A typical listing of the classes and species of surfactants useful in this invention appear in the books "Surface Active Agents", Vol. I, by Schwartz & Perry (Interscience 1949) and "Surface Active Agents", Vol. II by Schwarz, Perry and Berch (Interscience 1958), the disclosures of which are incorporated herein by reference. The listing, and the foregoing recitation of specific surfactant compounds and mixtures which can be used in the specific surfactant compounds and mixtures which can be used in the instant compositions, are representative but are not intended to be limiting.

In addition thereto the bleaching and detergent compositions of the invention may contain any of the conventional components and/or adjuncts usable in fabric washing compositions.

As such can be named, for instance, other conventional or non-conventional detergency builders, inorganic or organic, which can be used together with the sequestrant builder up to a total builder level of about 95% by weight, preferably up to about 80% by weight.

Examples of suitable other inorganic builders are silicates and carbonates. Specific examples of such salts are sodium and potassium silicates and carbonates. Examples of organic builders are alkylmalonates, alkylsuccinates, nitrilotriacetates and carboxymethyloxymalonates.

Other components/adjuncts commonly used in detergent compositions are for example soil-suspending agents such as water-soluble salts of carboxymethylcellulose, carboxyhydroxymethylcellulose, copolymers of maleic anhydride and vinyl ethers, and polyethylene glycols having a molecular weight of about 400 to 10,000. These can be used at levels of about 0.5% to about 10% by weight.

Dyes, pigments, optical brighteners, perfumes, anti-caking agents, suds control agents, enzymes and fillers can also be added in varying amounts as desired.

Fabric-softening agents, both cationic and nonionic in nature, as well as clays, e.g. bentonite and zeolite, can also be added to provide softening-in-the-wash properties.

The detergent compositions of the invention are preferably presented in free-flowing particulate, e.g. powdered or granular form, and can be produced by any of the techniques commonly employed in the manufacture of such detergent compositions, but preferably by slurry-making and spray-drying processes to form a detergent base powder to which the heat-sensitive ingredients, including the peroxygen bleaching agent and optionally some other ingredients as desired, and the heavy metal adjunct, preferably the manganese adjunct, are added as dry substances.

EXAMPLES I AND II

I. An adjunct was prepared by gently rotating manganous sulphate tetrahydrate crystals (2.5 parts by weight) with microsized silica of 3–4 μm (1 part by weight) in a sealed polythene drum for one hour. The aim of this exercise was to totally enclose each crystal with a layer of silica so that moisture/alkalinity contact would be minimised.

II. Another adjunct was prepared as in Example I using 4.054 parts by weight of manganous sulphate tetrahydrate and 0.4 parts by weight of microsized silica of 3–4 μm.

EXAMPLE III

The following particulate detergent and bleach compositions (A) comprising sodium percarbonate as the peroxygen bleaching agent, with and without added manganese/ethylene diamine tetraacetate (Mn/EDTA) complex were prepared and stored in non-laminated carton packs at 37° C./70% RH (relative humidity).

The stability of the sodium percarbonate in both compositions was monitored and depicted on the graphs as shown in FIG. 1. It is clear that precomplexed Mn/EDTA dry-mixed with a peroxygen bleach containing detergent composition (II) causes rapid decomposition of the bleach as compared with the control formulation without added Mn/EDTA (I).

In another experiment the following particulate detergent and bleach composition (B) comprising sodium perborate as the peroxygen bleaching agent was prepared (control composition I).

Composition II=Composition I+$MnSO_4.4H_2O$ dusted with microsized silica (3–4 μm) of Example II.

Composition III=Composition I+$MnSO_4.4H_2O$ dusted with 10% calcite (3–4 μm).

The compositions were stored in non-laminated 50 g carton packs at 37° C./70% RH and the stability of the sodium perborate was monitored in each pack.

Figure 2:
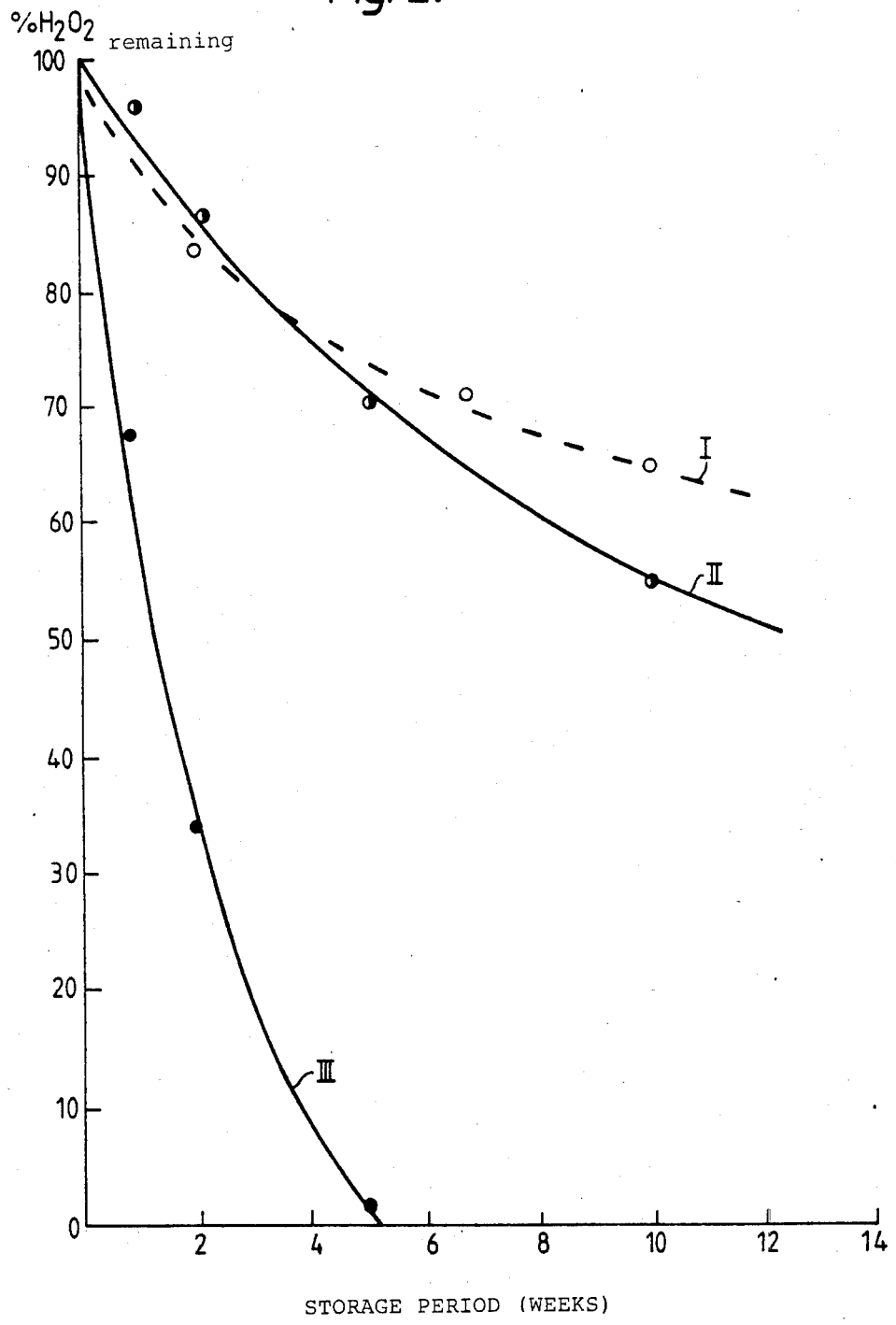

The results are depicted on the graphs as shown in FIG. 2. Composition II, containing the adjunct of the invention is clearly superior to Composition III.

| Compositions (% by weight) | A (I) | B (I) |
|---|---|---|
| Anionic surfactant | 28.0 | 20.0 |
| Sodium carbonate | 27.0 | 13.0 |
| Sodium triphosphate | — | 12.0 |
| Sodium silicate | 11.0 | 7.5 |
| Sodium bicarbonate | 4.8 | — |
| Sodium sulphate | 4.8 | 18.0 |
| Sodium carboxymethylcellulose (SMCM) | 0.8 | 0.4 |
| Fluorescer | 0.16 | 0.2 |
| Ethylene diamine tetraacetate (EDTA) | 0.2 | — |
| Sodium percarbonate | 20.0 | — |
| Sodium perborate tetrahydrate | — | 20.0 |
| Moisture | up to 100% | |
| Mn/EDTA complex added to AI | 0.56 (AII) | — |
| $MnSO_4.4H_2O$ dusted with calcite added to BI | | 0.6 (BII) |
| $MnSO_4.4H_2O$ dusted with microsized silica added to BI | | 0.6 (BIII) |

We claim:

1. A stable heavy metal adjunct for use as a bleach catalyst comprising a matrix of a heavy metal salt having atomic numbers of from 24 to 29 provided with a surface powder coating of desiccant microsized inert powdered material with a mean particle size of less than 25 μm in an amount of from 0.5 to 20% by weight of the heavy metal salt.

2. Heavy metal adjunct according to claim 1, wherein said heavy metal salt is a manganese (II) salt.

3. Heavy metal adjunct according to claim 1, wherein said microsized powdered material has a mean particle size of less than 10 μm.

4. Heavy metal adjunct according to claim 1, wherein said microsized powdered material is microsized silicon dioxide (silica).

5. Heavy metal adjunct according to claim 1, wherein said surface powder coating of microsized powdered material is provided in an amount of from 1 to 10% by weight of the heavy metal salt.

6. Process for preparing a stable heavy metal adjunct for use as a bleach catalyst comprising dusting a heavy metal salt having atomic numbers of from 24 to 29 with a desiccant microsized inert powdered material with a mean particle size of less than 25 μm to an amount of from 0.5 to 20% by weight of said heavy metal salt.

7. Process according to claim 6, wherein said heavy metal salt is a manganese (II) salt.

8. Process according to claim 6, wherein said microsized powdered material has a mean particle size of less than 10 μm.

9. Process according to claim 6, wherein said microsized powdered material is microsized silicon dioxide (silica).

10. Process according to claim 6, wherein said surface powder coating of microsized powdered material is provided in an amount of from 1 to 10% by weight of the heavy metal salt.

11. A solid particulate bleaching and detergent composition comprising 5 to 90% by weight of a peroxygen bleaching agent, 5 to 95% by weight of a sequestrant builder and from 0.025 to 10% by weight of a heavy metal adjunct comprising a matrix of a heavy metal salt having atomic numbers of from 24 to 29 provided with a surface powder coating of desiccant microsized inert powdered material with a mean particle size of less than 25 μm, the surface powder coating being applied in an amount of from 0.5 to 20% by weight of said heavy metal salt.

12. A composition according to claim 11, wherein said heavy metal salt is a manganese (II) salt.

13. A composition according to claim 11, wherein said microsized powdered material is microsized silicon dioxide (silica).

14. A composition according to claim 11, wherein said microsized powdered material has a mean particle size of less than 10 μm.

15. A composition according to claim 11, which further comprises from 2 to 50% by weight of a surface-active agent selected from the group of anionic, non-ionic, zwitterionic and cationic surface-active agents, and mixtures thereof.

16. A composition according to claim 11, comprising 0.05 to 5% by weight of said heavy metal adjunct.

* * * * *